US006799863B2

(12) United States Patent
Offiler et al.

(10) Patent No.: US 6,799,863 B2
(45) Date of Patent: Oct. 5, 2004

(54) ADJUSTABLE UTILITY LIGHT

(75) Inventors: Stephen B. Offiler, North Scituate, RI (US); Marcus D. J. Poisson, Weare, NH (US)

(73) Assignee: Central Tools, Inc., Cranston, RI (US)

( * ) Notice: Subject to any disclaimer, the term of this patent is extended or adjusted under 35 U.S.C. 154(b) by 195 days.

(21) Appl. No.: 10/286,114

(22) Filed: Nov. 1, 2002

(65) Prior Publication Data

US 2004/0085761 A1 May 6, 2004

(51) Int. Cl.[7] ..... F21V 19/06
(52) U.S. Cl. ..... 362/220; 362/217; 362/260
(58) Field of Search ..... 362/119, 120, 362/220, 225, 226, 249, 260, 310, 368, 370, 388, 389, 404, 432, 413, 457, 458

(56) References Cited

U.S. PATENT DOCUMENTS

| | | | | |
|---|---|---|---|---|
| 2,532,023 A | * | 11/1950 | Guth, Jr. | 362/220 |
| 4,070,571 A | * | 1/1978 | Robertson et al. | 362/217 |
| 4,103,781 A | * | 8/1978 | Sterling | 211/119.009 |
| 4,337,503 A | * | 6/1982 | Turner | 362/474 |
| 4,598,343 A | * | 7/1986 | Sorrell | 362/216 |
| 5,217,300 A | * | 6/1993 | Lwery | 362/387 |
| 5,243,505 A | * | 9/1993 | Carr | 362/275 |
| 5,528,477 A | * | 6/1996 | Carmo | 362/260 |
| 5,765,941 A | * | 6/1998 | Vest | 362/260 |
| 6,164,803 A | * | 12/2000 | Reniger et al. | 362/477 |
| 6,169,373 B1 | * | 1/2001 | Riesinger | 315/200 A |

FOREIGN PATENT DOCUMENTS

JP 05028805 A * 2/1993 ..... F21S/3/12

* cited by examiner

*Primary Examiner*—Thomas M. Sember
*Assistant Examiner*—Hargobind S. Sawhney
(74) *Attorney, Agent, or Firm*—Myron Greenspan; Lackenbach Siegel LLP

(57) ABSTRACT

An adjustable utility light for suspension from an object has a nominal width and lateral edges, and both an elongate hollow member with opposing open ends and an axis. A pair of generally elongate gripping members is also present, each with a free gripping end and a hollow member engaging end. The gripping members are slidably and rotatably mounted with regard to associated open ends of the hollow member so as to be able to change the axial distance between the gripping members. An elongate biasing member extends through the hollow member and is attached at opposite ends to the gripping member. The biasing member is generally under tension so as to urge the gripping members towards each other, minimizing the distance between them. It is stretchable upon separation along the axis of the gripping members against its own biasing forces. An elongate lamp is provided with an axial length generally equal to the nominal width of the hollow member. Support means secure and support the lamp on the hollow member, so that the gripping members are axially separated to a distance greater than said minimal width and are enabled to engage and grip the lateral edges of the object and suspend the lamp for illuminating a region below the object.

20 Claims, 4 Drawing Sheets

ADJUSTABLE UTILITY LIGHT

BACKGROUND OF THE INVENTION

1. Field of the Invention

The invention generally relates to utility lights and, more specifically, to an adjustable utility light suitable for being suspended from the hood of a vehicle or the like.

2. Description of the Prior Art

Automobile mechanics frequently use utility lights to illuminate remote or recessed areas that are not adequately illuminated by room or ambient light. Such conditions are especially aggravated when working on automobile engines, which are covered from above, fully or partially, by a hood that serves to block room or ambient light. Since much work is performed is under the hood of automobiles, it is particularly useful to introduce additional or auxiliary illumination under the hood to illuminate the engine and associated components.

Existing products include a fluorescent light fixture connected to a bracket featuring spring-loaded hooks that allow the bracket to be temporarily installed under the vehicle hood or inserted in other places on the vehicle. See, for example, U.S. Pat. No. 4,197,573 for a droplight construction. The light disclosed in the aforementioned patent includes a hollow frame and retractable and rotatable hooks at each end of the frame, at least one of the hooks being connected through a spring to a center post of the frame. Incandescent lamp sockets are provided at opposing ends of the frame. One problem with the construction is the requirement that the springs within the frame be connected to a center post in the frame, which is not very accessible. The resulting construction is, therefore, more complex to assemble and more costly to manufacture than necessary.

A portable work light is disclosed in U.S. Pat. No. 5,836,679, which has a fluorescent-type lamp and a pair of fasteners attached to the tube. A cord is formed as an adjustable loop. Fasteners are provided for suspending the work light to the cord. However, such work light requires an external adjustable loop that needs to be placed around a member, such as the hood of an automobile. The entire cord assembly, therefore, is exposed, making the cord more susceptible to damage from sharp objects, including the edges of the hood itself. The elongate cord can also engage or snag other items in a workshop or garage, making the item more cumbersome to use.

A magnetically mounted work light is disclosed in U.S. Pat. No. 5,457,614 that includes a pair of magnetic base members for supporting a light on a magnetic surface. Arcuate arms extend from each of the base members and a fluorescent light is supported at an end of the arms spaced from the base members. The arms may be pivoted relative to the base members in order to position the light at a desired location relative to a work area. However, such magnetically mounted light may not be as stably secured, to the extent desired, to a surface, such as a hood of an automobile. Jarring the light with a tool or other device might cause the light to be knocked off the magnetic supporting surface. Also, being made of a welded construction with arcuate arms, the work light is bulky and difficult to store when not in use. Similar remarks can be made for the fluorescent utility light disclosed in U.S. Pat. No. 5,436,815.

SUMMARY OF THE INVENTION

Accordingly, it is an object of the invention to provide an adjustable utility light that does not have the disadvantages inherent in the utility lights that have been known.

It is another object of the present invention to provide an adjustable utility light that is simple in construction and economical to manufacture.

It is still another object of the invention to provide an adjustable utility light that is convenient to use.

It is yet another object of the invention to provide a utility light of the type under discussion that can be well secured to an object with minimum risk that the light will be jarred or inadvertently separated from the object.

It is still a further object of the invention to provide an adjustable utility light as in the previous objects that provides significant and substantially uniform illumination to a work area.

It is yet a further object of the invention to provide an adjustable utility light as in the previous objects that is particular suitable for providing illumination during maintenance and repair of automobiles, light trucks and similar vehicles.

In order to achieve the above objects, as well as others that will be become apparent hereinafter, an adjustable utility light for suspension from an object having a nominal width and lateral edges comprises an elongate hollow member having opposing ends and defining an axis. A pair of generally elongate gripping members each has a free gripping end and a hollow member engaging end. Such gripping members are slidably and rotatably mounted relative to associated open ends of said hollow member to change the axial distance between said gripping members. An elongate biasing member extends through the entire length of said hollow member and attached at opposite ends to said gripping member. Said biasing member is generally under tension to urge said gripping members towards each other to minimize the distance between said gripping members. Said biasing member is stretchable upon separation along said axis of said gripping members against the biasing forces of said biasing member. An elongate lamp has an axial length generally equal to said nominal width of said hollow member. Support means is provided for securing and supporting said lamp on said hollow member. In this manner, axial separation of said gripping members to a distance greater than said nominal width enables said gripping members to engage and grip the lateral edges of the object and to suspend the lamp for illumination of a region below the object.

BRIEF DESCRIPTION OF THE DRAWINGS

The above and other objects of the invention may be more readily seen when viewed in conjunction with the accompanying drawings, wherein.

DESCRIPTION OF THE PREFERRED EMBODIMENTS

Figure 1:
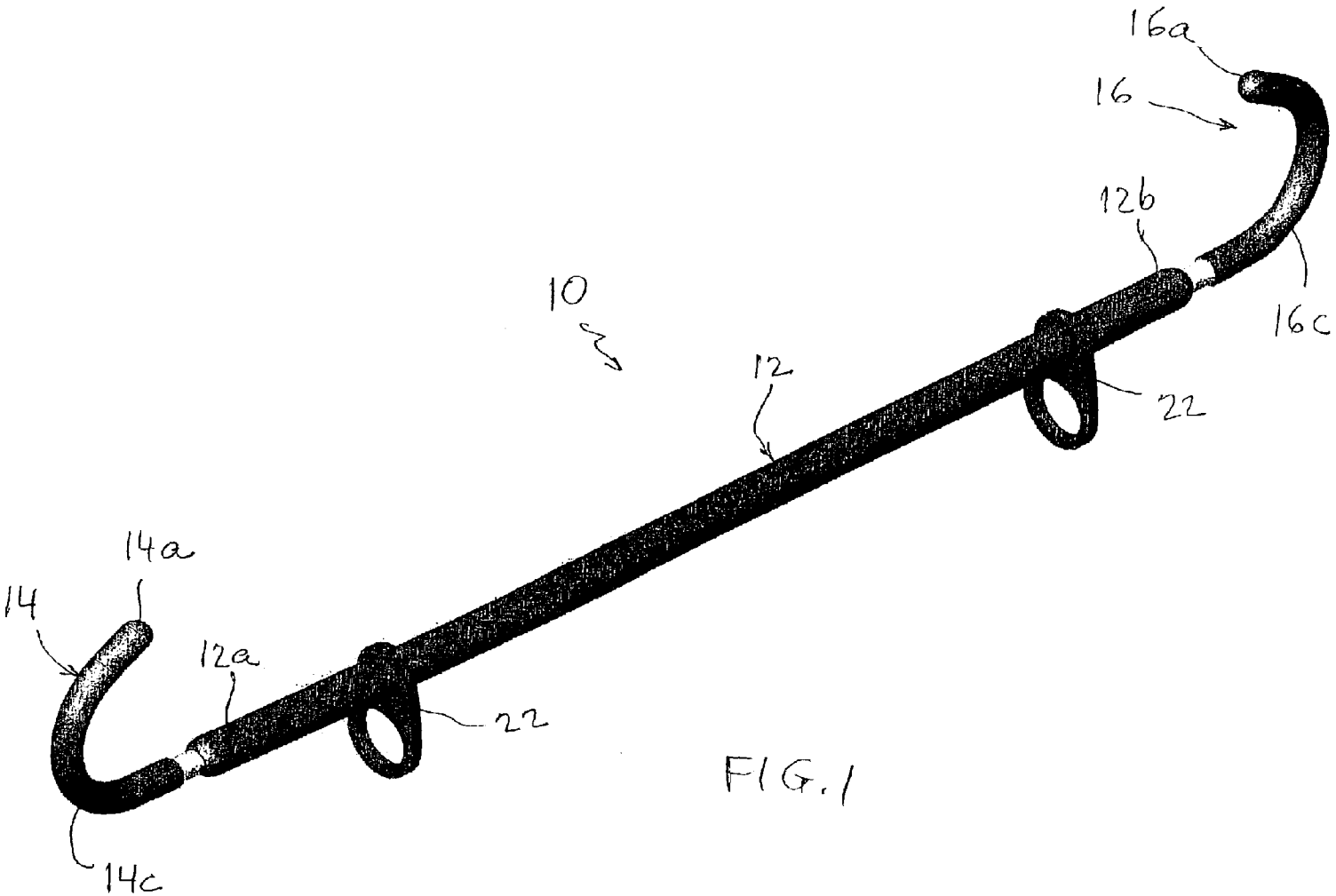
FIG. 1 is a perspective view of an adjustable utility light in accordance with the present invention, shown in its normal, relaxed condition, suitable for storage or shipment.
Figures 2, 3:
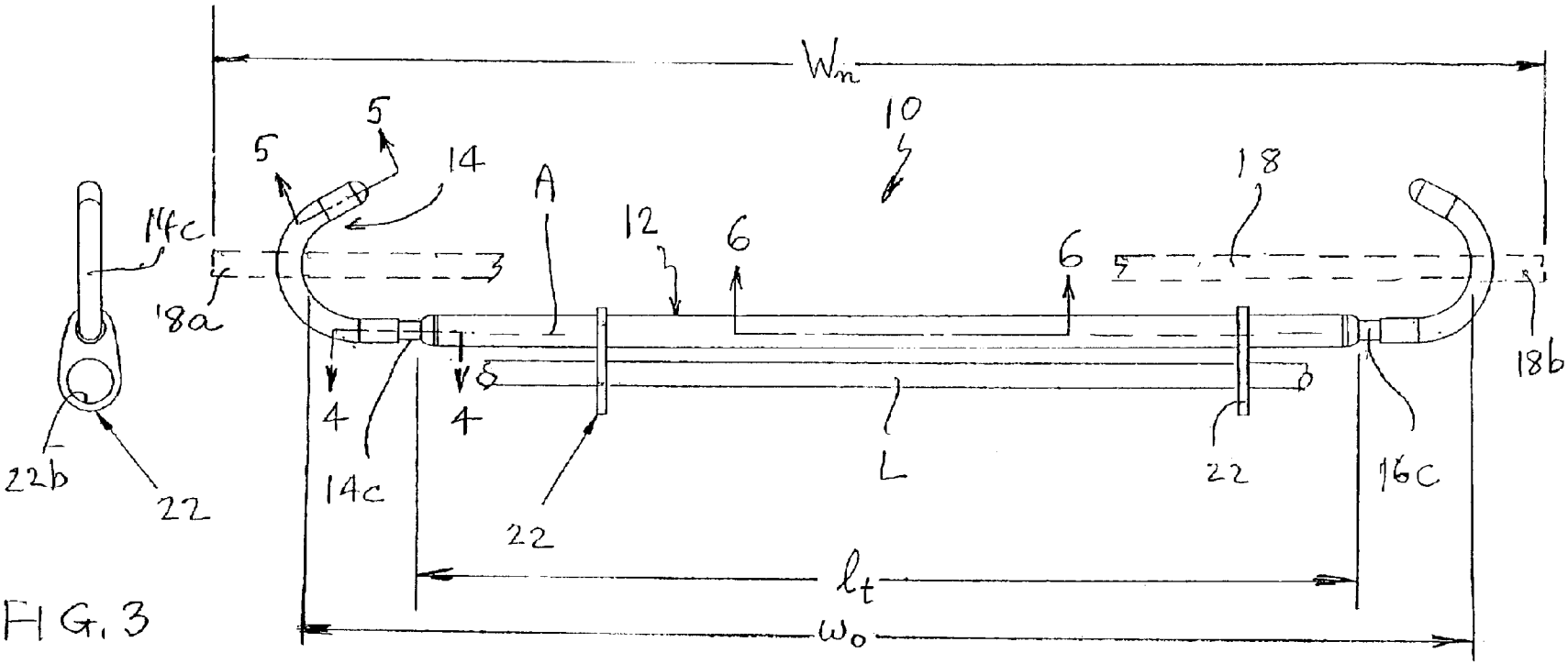
FIG. 2 is a side elevational view of the utility light shown in FIG. 1.
FIG. 3 is an end elevational view of the utility light shown in FIG. 2.

Referring now specifically to the Figures, in which identical or similar parts are designated by the same reference numerals, and first referring to FIGS. 1 and 2, an adjustable utility light in accordance with the present invention is generally designated by the reference numeral 10.

The utility light 10 is particularly suitable for suspension from an object having a nominal width and lateral edges, such as the hood of an automobile or truck or the like. The utility light 10 includes an elongate hollow member 12 having opposing open ends, 12*a*, 12*b*, and generally defining an axis A (FIG. 2). While the hollow member may have different constructions, the presently preferred embodiment for the hollow member 12 is a straight hollow tube having a generally circular cross section. It will be evident, however, that any other tubular member having square, rectangular or other cross sections may be used.

Figure 4:
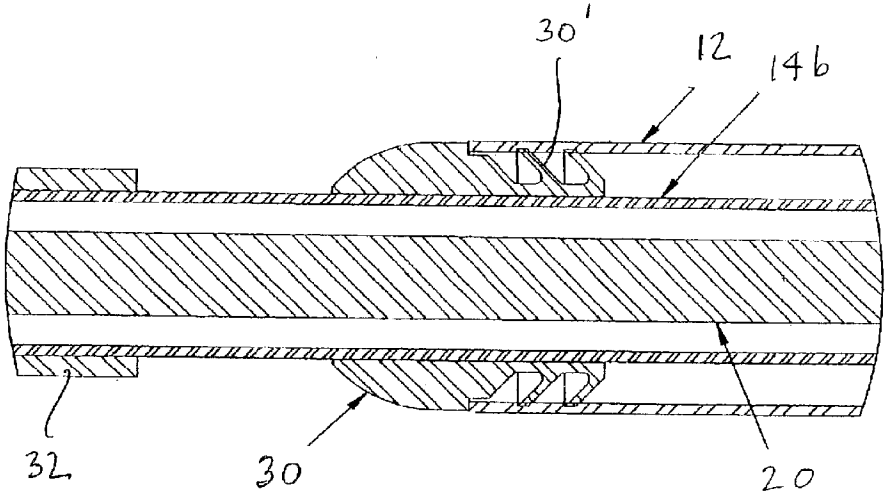
FIG. 4 is a longitudinal or axial cross section of a detail taken along line 4—4 in FIG. 2.

A pair of generally elongate gripping members 14, 16 are provided, each having a free gripping end, 14*a*, 16*a*, respectively, and a hollow member engaging end, 14*b*, 16*b* (FIG. 4). The gripping members 14, 16 are slidably and rotatably mounted relative to an associated open end 12*a*, 12*b*, of the hollow member 12, in a manner to be more fully described below, to change the axial distance $w_o$ between the gripping members, 14, 16. In FIGS. 1, 2 the gripping members are fully telescoped into the associated open ends of the tube 12, such as during its normal or quiescent state when the utility light is ready to be stored or shipped.

In FIG. 2, an object from which the utility light is to be suspended is designated by the reference numeral 18, having a nominal width $W_n$. In the presently preferred embodiment, the gripping members 14, 16 are in the form of hollow tubes having arcuate free ends in the form or shape of hooks 14*c*, 16*c*. It will be appreciated that the specific shape of the hooks is not critical for purposes of the present invention, and any shape for the exterior gripping ends can be used, such as triangular hooks, square hooks, rectangular hooks and the like.

The inside dimension $w_o$ defined by the hooks 14*c*, 16*c* is generally smaller than the nominal dimension $W_n$ of the object from which the light is to be suspended when the gripping members are fully retracted or telescoped within the hollow member or tube 12. The length $l_t$ of the hollow member or tube 12 is, likewise, less than a nominal width $W_n$ of the object from which the light is to be suspended. The sizes and configuration of the hooks 14*c*, 16*c* are selected such that, as suggested above, the relaxed or normal quiescent state of the hooks are such that the dimension $w_o$ is less than $W_n$.

A feature of the invention is that the gripping members 14, 16 are slidably and rotatably mounted relative to the associated open ends of 12*a*, 12*b* of the hollow member 12 to change the axial distance $w_o$ between the gripping members 14, 16.

Figure 5:
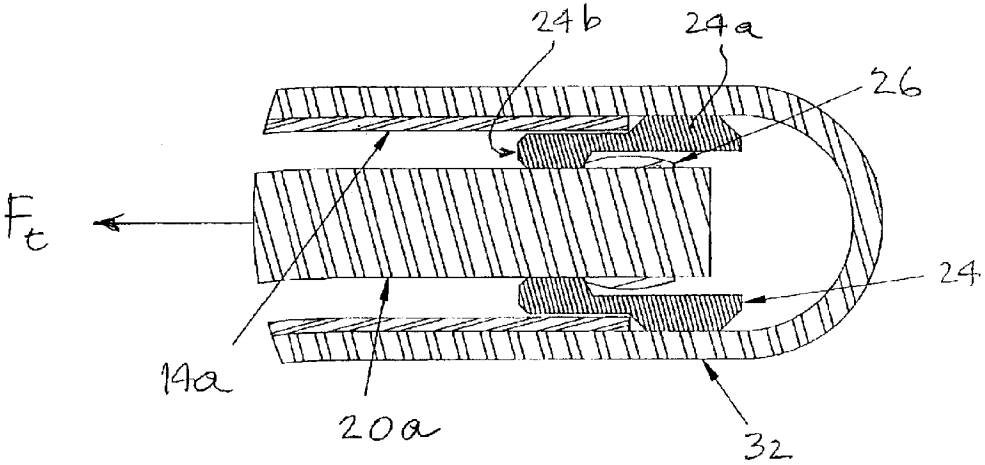
FIG. 5 is an axial or longitudinal cross-section, taken along line 5—5 in FIG. 2.
Figure 6:
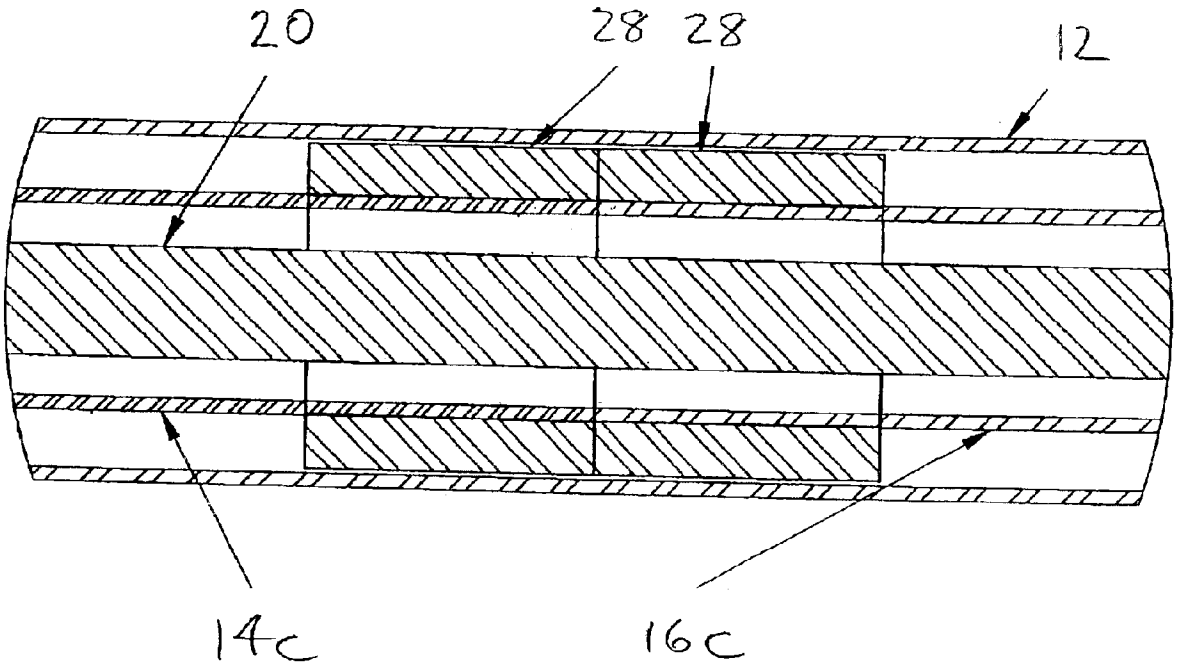
FIG. 6 is an axial or longitudinal cross section of the utility light shown in FIG. 2, taken along line 6—6.

Referring to FIGS. 4—6, an elongate biasing member 20 is provided that extends through the hollow member or tube 12 and is attached at opposite ends (e.g., end 20*a* in FIG. 5) to the gripping members 14, 16. The biasing member is stretchable upon manual separation of the gripping members 14, 16, along the axis A, against the biasing or pulling forces of the biasing member 20.

The specific nature of the biasing member 20 is not critical, and any elongate elastic member can be used, with different degrees of advantage. In accordance with the presently preferred embodiment, the spring-loaded members that form the biasing member rely on a multi-strand elastic cord with a woven jacket commonly known as a "bungee cord."

An elongate lamp L, shown in FIG. 2 is provided, that has an axial length generally equal to the length $l_t$ of the hollow member or tube 12. The specific length of the lamp L in relation to the tube 12 is not, however, critical for purposes of the present invention. On the one hand, in order to fully optimize and maximize the illumination provided by the adjustable light, the lamp L should be as large as possible. However, since the lamp L will be used to illuminate a region essentially below a hood or the like 18, it is generally unnecessary to make the length of the lamp L wider than that the nominal width $W_n$. Furthermore, by making the lamp project beyond the axial ends of the tube or member 12, this may subject the lamp to more damage, without additional benefits. Thus, in order to maximize the amount of illumination while providing protection to the lamp, the axial length of the lamp L should normally be between the axial length of the tube, $l_t$, and the unextended axial separation $w_o$ of the hooks 14, 16.

Suitable supports 22 are provided in the form of two spaced hangers. Each support 22 includes a first opening 22*a* dimensioned to receive and frictionally engage the external surface of the tube 12, and a spaced opening 22*b* dimensioned to frictional engage the lamp L. The supports 22, therefore, use very simple diecut rubberlike parts with two spaced holes, as necessary, to accept the tube 12 and the tubular-shaped lamp L. The rubber also secondarily acts to cushion the lamp L from shocks and vibrations that may be applied to the tube 12. In place of the supports 22 shown, one or two open resilient or deformable hooks may be used that can be easily snapped onto the tube 12. This allows rapid installation and removal of the supports 22 to the tube 12, and/or rapid installation and removal of the lamp.

In order to eliminate complicated designs that suffer from excessive part counts and complexity of parts, the present invention is formed of very few and very simple parts, making it significantly less expensive to manufacture. Thus, referring to FIGS. 4–6, the biasing member 20, in the form of a bungee cord, extends between the free gripping ends 14*a*, 16*a* of associated gripping members 14, 16. The biasing member has a diameter smaller than the inside diameters of both the central tube 12 and the tubes from which gripping members 14, 16 are formed. As best shown in FIG. 5, the free end 20*a* of the biasing member 20 extends to the very end and, preferably, somewhat beyond the free end of the tubes forming the hooks. Suitable retaining means is provided for retaining each opposite end 20*a* to the end of the tube forming the hooks of the associated gripping member. The specific nature of such retaining means is not critical, and it will be evident to those skilled in the art that numerous such retaining mechanisms are available that can be used, with differing degrees of advantage. In the illustrated embodiment, such retaining means in is the form of an end cap 24 having an axially exterior portion 24*a* having external dimension greater than the internal dimensions of the tubes forming the free gripping ends of the hooks 14*a*, 16*a*, and having an axially interior portion 24*b* that extends between the interior surface of the tube 14*a* and the biasing member 20 to engage the biasing member in press fit relationship. In some instances, the inside dimensions of the interior portion 24*b* may be selected to provide significant frictional engagement with the free ends of the biasing member, to prevent it from being pulled in or retracted within the hook tubes 14*a*, 16*a*. In the preferred embodiment, an annular sleeve or bead 26 is crimped to the remote end of the biasing member 20. The end cap 24 engages the biasing member 20 at a axial position interiorly of the crimped annular sleeve 26 to provide an interference fit to prevent the end 20*a* of the biasing member through the gripped member 14 to essentially lock the end of the biasing member 20 to the free end of the hook tube 14*a*, substantially regardless of the axial or tensile forces $F_t$ (FIG. 5) that may be exerted on the biasing member. Another function of end cap 24 is that it prevents the outermost edge of hook 14, 16 from cutting the protective covering 32 from within.

Another feature of the invention is to provide simple plastic parts that can be produced by molding or machining to support the telescoping tubes relative to each other. The parts, to be more fully described, serve both to center the hollow member engaging ends 14*b*, 16*b* centered within the hollow member 12 to facilitate telescopic movements. However, such centering, in addition to assuring proper and desired telescoping movements between the gripping members and the central tube, also ensure that the edges of the tubes forming the free ends of the gripping received within the central tube do not rub against, damage or ultimately compromise the integrity of the biasing members in the form of bungee cords 20. Thus, for example, annular pistons 28 are securely mounted to the hollow member engaging ends 14*b*, 16*b*. These are shown in FIG. 6 as a generally cylindrical or annular sleeve securely mounted to their associated ends of the hook tubes and disposed between the hook tubes and the main tube 12. The pistons 28 may be attached or secured to the hook tubes in any conventional manner, including dimensionally to provide press fits and are held in place with adhesives to simplify assembly and reduce fastener count. In FIG. 6, the pistons 28 are shown abutting against each other, as are the opposing hook tube ends 14*b*, 16*b*, in the condition when the hooks are fully retracted within the tube. The pistons 28 not only maintain the hook tubes aligned and facilitate and promote easy sliding or telescoping of the cooperating part, but also assure that the hook tubes perfectly abut against each other in the quiescent or relaxed condition of the utility light so that these tubes are not deformed or in any other way damaged. In order to optimize the efficiency of the pistons 28, these are preferably made of a material having a low coefficient of friction, such as a plastic material like Nylon, PVC, Acetyl, etc.

In order to reduce the weight of the utility light 10, the light is preferably made of simple, round-section tubing, as suggested, with a large-diameter main section and small-diameter telescoping ends that are formed into the hooks 14, 16. A preferred method of construction using aluminum tubing. While the plastic parts, as suggested, can be produced by molding or machining, the hollow nature of tubing allows the biasing member or the bungee to be self-guided during installation, which simplifies manufacturing. The bungee can be easily threaded from one hook-tube through the main tube, then through the opposite hook-tube, and subsequently pre-tensioned and terminated with simple crimped connections.

Referring to FIG. 4, additional parts may be provided at the axial ends of the main tube 12, such as parts 30. Such parts are preferably provided with pressure generating members 30' that engage the inner surface of the main tube 12 and resist being extracted from the main tube. The members 30 are preferably provided with a ledge or annular rim that is arranged to abut against the circular edge of the main tube 12, in order to provide both a low friction sliding surface for relative movements between the main tube 12 and the hook tube, as well as provide closure to essentially close or seal the ends of the main tube to prevent dirt, grease and the like from entering therein.

As will be evident, since the biasing member or bungee cord 20 can be twisted about its own axis, the gripping members 14, 16 can themselves be rotated 360° relative to each other. It will also be evident that, in accordance with the broader aspects of the invention, only a single gripping member 14, 16 needs to be movable relative to the intermediate tube 12. Since the only critical or important functional requirement is that the gripping members 14, 16 be movable relative to each other, it will be clear that one of these can be fixed in relation to the tube 12, while the other is axially movable to change the distance $w_o$. However, in the presently preferred embodiment, both gripping members 14, 16 are similar mounted and telescopically movable, as suggested.

Referring to FIG. 5, the free gripping ends 14*a*, 16*a* are preferably provided with a covering material or tubular sleeve 32 that covers and protects the ends 20*a* of the bungee cord as well as the end cap 24. The hooks 14*c*, 16*c*, which typically contact the vehicle's finish during use, are preferably protected and made non-marring with soft covers made of vinyl, rubber or a similar compliant material. In additional to protecting both the hooks themselves as well as the finish on the object 18, the material is preferably made of a material, such as rubber, that also enhances the friction between the hooks 14*c*, 16*c* and the object on which the light is suspended. This become an important consideration when the utility light is suspend on the side of the hood of a vehicle, which hood can assume a significant angle in relation to the horizontal. The degree to which the adjustable light will remain in the selected position on the hood and resist downward sliding will, of course, be a function of the coefficient of friction of the material 32, as well as the tension or pulling forces on the hooks by the biasing member or bungee cord. These parameters can be selected and adjusted to prevent undesired slippage along the lateral edges 18*a*, 18*b* under all conditions of use. If desired, an additional elongate member, whether rigid or flexible, can be provided that is connected at any point to the central tube 12 and another end that can be secured to an end portion of the object 18 (such as the front end of a hood of an automobile) in order to fully eliminate sliding action or to provide the desired result with lower tension bungee cords or the use of lower friction exhibiting materials 32.

It will be evident, therefore, that a very simple and inexpensive construction of the adjustable utility light in accordance with the present invention satisfies all of the operating features and overcomes some of the disadvantages inherent in prior art utility lights.

While this invention has been described in detail with particular reference to preferred embodiments thereof, it will be understood that variations and modifications will be effected within the spirit and scope of the invention as described herein and as defined in the appended claims.

What we claim:

1. Adjustable utility light for suspension from an object having a nominal width and lateral edges, comprising an elongate hollow member having opposing open ends and defining an axis; a pair of gripping members each having a free gripping end and a hollow member engaging end, said gripping members being slidably mounted relative to associated open ends of said hollow member to change the axial distance between said gripping members; an elongate biasing member extending through said hollow member and being attached at opposite ends to said gripping members, said biasing member generally being under tension to urge said gripping members towards each other to minimize the distance between said gripping members, said biasing member being stretchable upon separation along said axis of said gripping members against the biasing forces of said biasing member; an elongate lamp having an axial length generally equal to said length of said hollow member; and support means for securing and supporting said lamp on said hollow member, whereby axial separation of said gripping members to a distance greater than said nominal width enables said gripping members to engage and grip the lateral edges of the object and to suspend the lamp for illuminating a region below the object.

2. An adjustable utility light as defined in claim 1, wherein said elongate hollow member comprises a hollow tube.

3. An adjustable utility light as defined in claim 2, wherein said gripping members are formed of hollow tubes having outer diameters smaller than an inner diameter of said hollow tube and slidably received through said open ends.

4. An adjustable utility light as defined in claim 1, wherein said gripping members are generally in the shape of hooks.

5. An adjustable utility light as defined in claim 1, wherein said biasing member is in the form of an elongate elastic member.

6. An adjustable utility light as defined in claim 5, wherein said elastic member comprises a bungee cord.

7. An adjustable utility light as defined in claim 5, wherein each opposite end of said biasing member extends proximate to a free gripping end of an associated gripping member and has an outer diameter smaller than an inside diameter of said free gripping end, and retaining means for retaining each opposite end of said biasing member to a free gripping end of an associated gripping member.

8. An adjustable utility light as defined in claim 7, wherein said retaining means comprises an end cap having an axially exterior portion having external dimensions greater than the internal dimensions of said free gripping ends and having an axially interior portion extending between the interior surface of said free gripping end and said biasing member frictionally engages said biasing member, whereby said end cap secures said opposite ends of said biasing member to said gripping members.

9. An adjustable utility light as defined in claim 8, wherein an annular sleeve is crimped at each remote end of said biasing member, said end cap engaging said biasing member at an axial position interiorly of said crimped annular sleeve to provide an interference fit to prevent the ends of said biasing member through said gripping member.

10. An adjustable utility light as defined in claim 8, wherein each hollow member engaging end comprises an elongate tubular portion received within said elongate hollow member; and centering means for maintaining said hollow member engaging ends centered within said hollow member to facilitate telescopic movements.

11. An adjustable utility light as defined in claim 10, wherein said centering means comprises annular pistons positioned between said hollow member and said hollow member engaging ends.

12. An adjustable utility light as defined in claim 11, wherein said pistons are attached to said hollow member engaging ends to move therewith relative to said hollow member.

13. An adjustable utility light as defined in claim 12, wherein said pistons are press fit in associated hollow member engaging ends.

14. An adjustable utility light as defined in claim 12, wherein said pistons are formed of a material having a low coefficient of friction.

15. An adjustable utility light as defined in claim 14, wherein said material is a plastic material.

16. An adjustable utility light as defined in claim 1, wherein said lamp is a fluorescent bulb.

17. An adjustable utility light as defined in claim 1, where in said support means comprises at least two spaced hangers attached to said hollow member and having openings below said hollow member for receiving said elongate lamp.

18. An adjustable utility light as defined in claim 1, wherein said hollow and gripping members are formed of aluminum.

19. An adjustable utility light as defined in claim 1, wherein said gripping members are mounted for 360° rotation about said axes.

20. An adjustable utility light as defined in claim 1, further comprising friction enhancing means for covering at least portions of said gripping members for minimizing relative slippage along said lateral edges.

* * * * *